United States Patent [19]

Takada

[11] Patent Number: 4,687,029

[45] Date of Patent: Aug. 18, 1987

[54] MEANS FOR LIFTING MOTION OF A HEDDLE FRAME

[75] Inventor: Hiroshi Takada, Kyoto, Japan

[73] Assignee: Murata Kikai Kabushiki Kaisha, Kyoto, Japan

[21] Appl. No.: 774,297

[22] Filed: Sep. 10, 1985

[30] Foreign Application Priority Data

Sep. 18, 1984 [JP] Japan ..... 59-196370
Feb. 28, 1985 [JP] Japan ..... 60-39371

[51] Int. Cl.[4] ..... D03C 1/14
[52] U.S. Cl. ..... 139/84; 139/88; 139/89
[58] Field of Search ..... 139/82, 83, 84, 88, 139/89, 57

[56] References Cited

U.S. PATENT DOCUMENTS

| | | | |
|---|---|---|---|
| 4,222,415 | 9/1980 | Palau | 139/84 |
| 4,481,979 | 11/1984 | Mizuguchi | 139/84 |

FOREIGN PATENT DOCUMENTS

| | | | |
|---|---|---|---|
| 0066655 | 12/1982 | European Pat. Off. | 139/82 |
| 2306604 | 10/1976 | Fed. Rep. of Germany | 139/84 |
| 601281 | 3/1960 | Italy | 139/57 |
| 0163441 | 9/1984 | Japan | 139/84 |
| 0144764 | 3/1954 | Sweden | 139/84 |

*Primary Examiner*—Henry S. Jaudon
*Attorney, Agent, or Firm*—Spensley Horn Jubas & Lubitz

[57] ABSTRACT

Means for lifting motion of a heddle frame for use in a dobby having a heddle frame and a harness cord adapted for operating the heddle frame. A device for adjusting the level of the heddle frame is located internally of the side columns of the loom frame.

3 Claims, 14 Drawing Figures

MEANS FOR LIFTING MOTION OF A HEDDLE FRAME

BACKGROUND OF THE INVENTION

1. Field of the Invention

The present invention relates to a means for adjusting the level of a heddle frame.

2. Prior Art

In a loom equipped with the negative dobby, shedding is effected by the reciprocation of plural heddle frames carrying heddles thereon, with the dobby mounted at the upper portion of the frame of the loom. Harness cords are interconnected between the dobby and the heddle frames and are pulled by the dobby to raise the heddle frames. Springs are provided to urge the heddle frames in the downward direction and act to lower the heddle frames upon the pull exerted on the harness cords is released.

Problems with the Prior Art

With such a loom, it is necessary to set the heddle frames to the specified reference level for proper shedding when the loom is initially installed. Also, use causes these heddle frames to deviate from position, they must be adjusted at intervals. If the loom is operated without the heddle frames being reciprocated in timed relationship with one another, the weft thread cannot be passed at all or an irregular pattern of fabric would result. Adjusting the level of the heddle frames is called leveling and is done by adjusting on the length of the harness cord at a predetermined adjustment position that does not permit view of the heddle frame. Consequently, leveling is normally performed by a team of operators so that one operator can attend on the harness cords while in response to a signal sent by another operator standing in full view of the associated heddle frame. However, if leveling must be performed by a single person, difficulties are encountered.

SUMMARY OF THE INVENTION

The present invention provides a means for adjusting the level of a heddle frame that is designed for an operator attending the means while keeping an eye on the associated heddle frame that falls in full view from the position where the operator is doing the adjustments.

According to the present invention, the means for adjusting the level of a heddle frame is located internally of the side columns of the loom frame.

In the present invention, the level of the heddle frames can be easily adjusted on the adjustment means provided inside the side columns of the frame of a loom. Adjustments are performed with an eye on the heddle frame that is in full view from the position of the adjustment means. Accordingly, a single person can perform the adjustment in an easy and assured manner. Moreover, the adjustment means are mounted internally of the side columns of the frame of a loom, the overall dimension of the loom can be reduced.

BRIEF EXPLANATION OF THE DRAWINGS

FIG. 6 through 14 illustrate a fourth embodiment of this invention in which FIG. 6 is a front view;

FIG. 7 is an enlarged front view of a part of the embodiment of FIG. 6;

FIGS. 8 through 10 are front views showing a connecting rod;

FIG. 11 is a section taken on line XI—XI;

FIG. 12 is an enlarged front view showing a spring holding member;

FIG. 13 is a side view of the spring holding member of FIG. 12; and

FIG. 14 is a side view of the embodiment of FIG. 6, as seen from the righthand side of the loom in FIG. 6.

DESCRIPTION OF THE PREFERRED EMBODIMENTS

Figure 1:
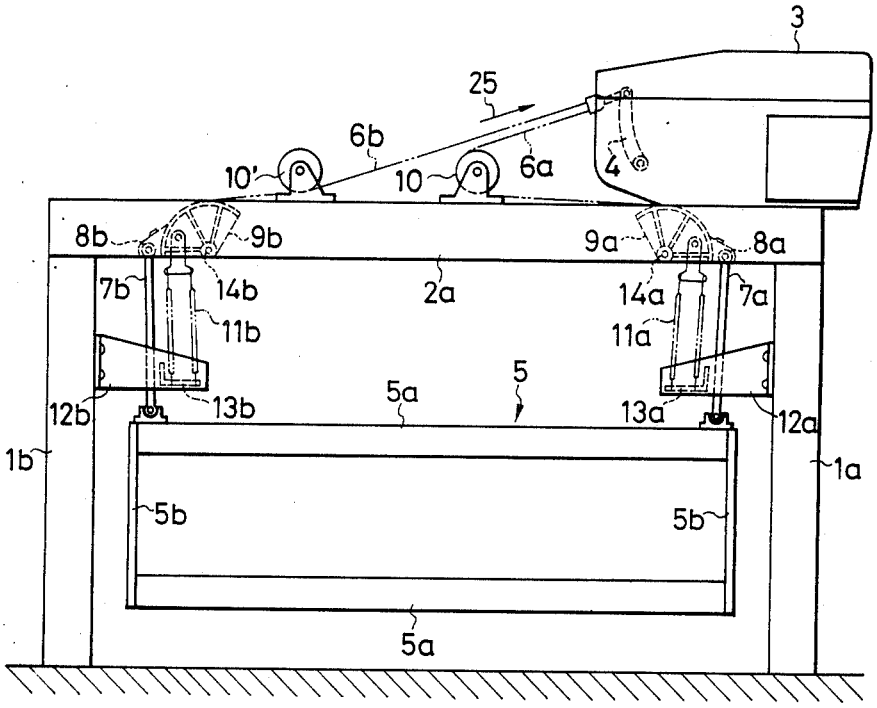
FIG. 1 is a front view showing a first embodiment of the present invention.
Figure 2:
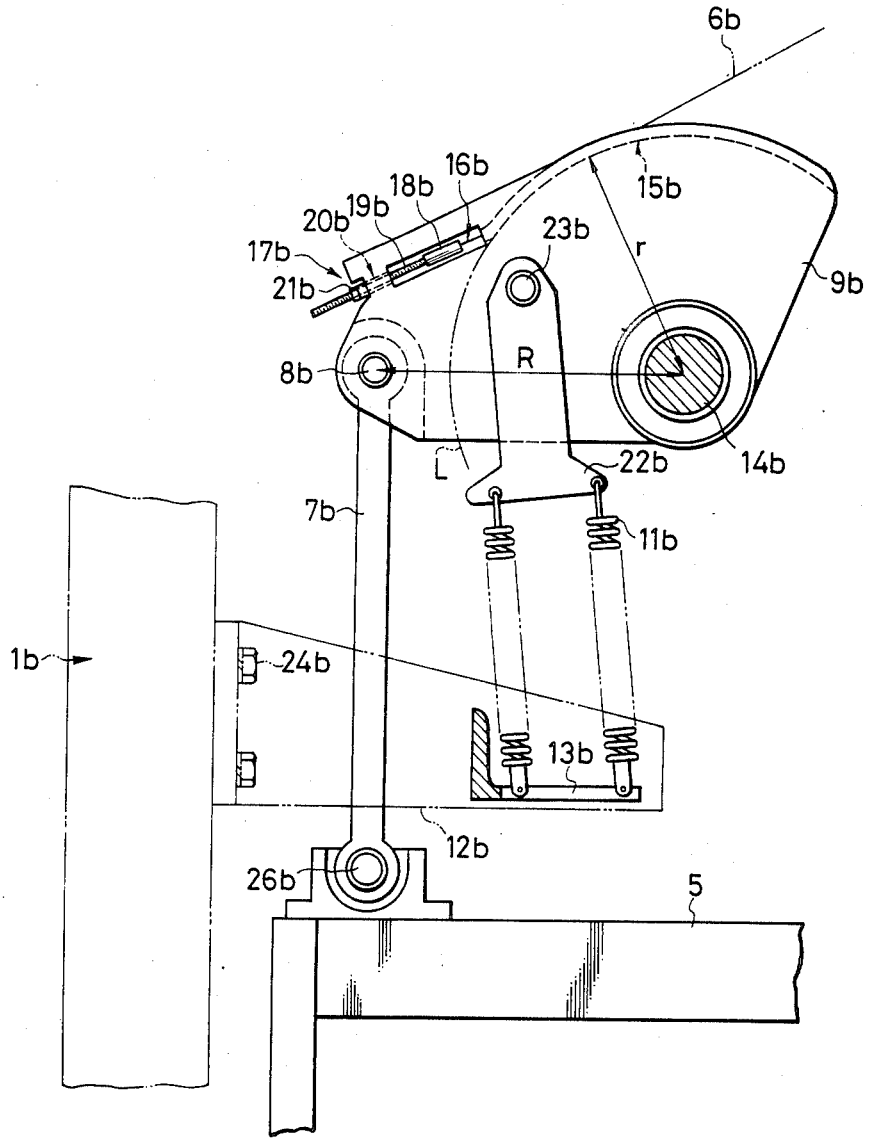
FIG. 2 is an enlarged front view of a part of the embodiment of FIG. 1.
Figure 3:
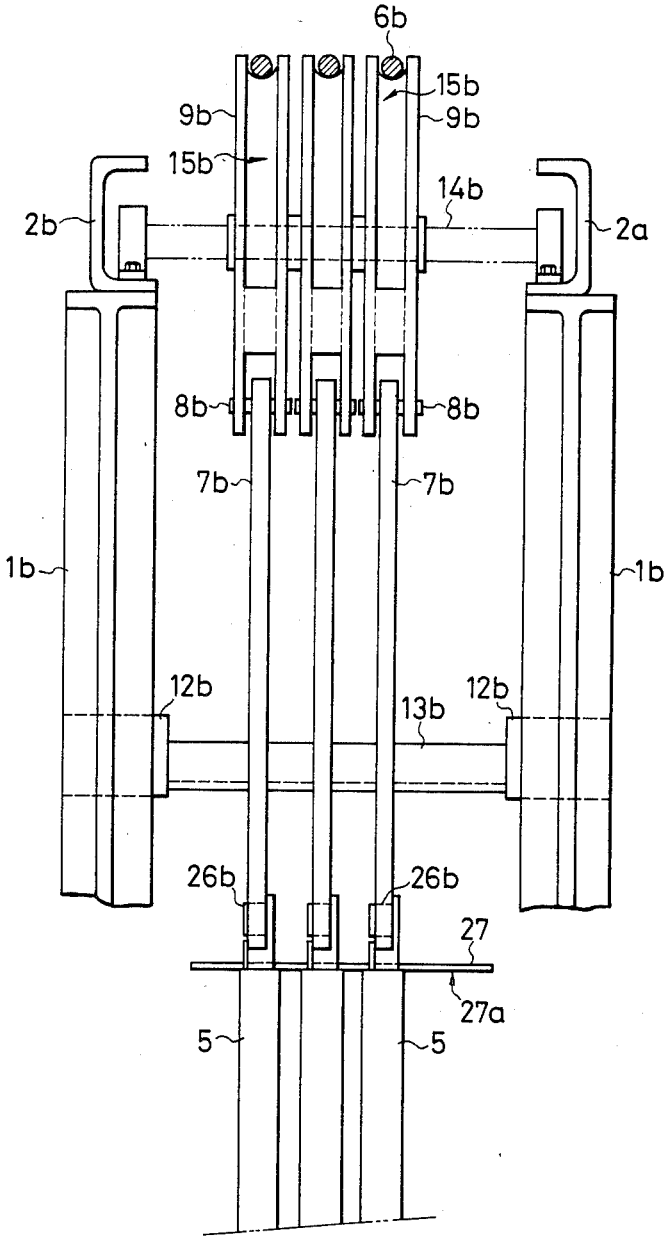
FIG. 3 is a side view of the embodiment of FIG. 1, as seen from the lefthand side of the loom in FIG. 1.

FIGS. 1 through 3 are different views showing a first embodiment of the present invention. Referring first to FIG. 1, a loom includes a frame comprising side columns 1*a* and 1*b* and a crossbeam 2*a* bridged at the top ends of the side columns. A dobby 3 is supported on the crossbeam 2*a* and has a jack lever 4. Harness cords 6*a* and 6*b* are connected at their one end to the jack lever 4 for operation of a heddle frame 5. The heddle frame comprises side frame members 5*b* and 5*b* and lower and upper cross members 5*a* and 5*a* and carries thereon a number of heddles (not shown), each having therein an eye through which an individual warp thread is passed. A loom normally operates a number of heddle frames, arranged in tandem, as shown in FIG. 3 which shows the side of a loom having three such heddle frames 5. Connecting rods 7*a* and 7*b* are connected at their one end to the opposite ends of the frame 5 and pivoted at their other ends to respective pins 8*a* and 8*b* that are provided respectively in rocking members 9*a* and 9*b*.

The harness cords 6*a* and 6*b* are adjustably secured at their opposite ends to the rocking members 9*a* and 9*b* through cable pulleys 10 and 10', respectively. The harness cords 6*a* and 6*b* extend in parallel between the cable pulleys 10 and 10', and the jack lever 4 as disclosed in the invention of Japanese Utility Model Publication No. 13910/82, which has been developed by inventors of this application.

The adjustable manners in which the harness cords are secured will later be described in more detail. Tension springs ll*a* and ll*b* are connected at their upper end to the rocking members 9*a* and 9*b* in such a manner as to urge through the associated connecting rods 7*a* and 7*b* the heddle frame 5 in the downward direction. The opposite ends of the springs ll*a* and ll*b* are secured to respective spring plates 13*a* and 13*b* that are fixed respectively in mounting brackets 12*a* and 12*b*. The mounting brackets 12*a* and 12*b* are affixed to the inside walls of the side columns l*a* and l*b* of the frame, respectively.

FIG. 2 is an enlarged view of the rocking member 9*b*, the function of which will be described. It should be understood that the following description regarding to the rocking member 9*b* also refer to the rocking member 9*a* and other relevant parts on the right side in FIG. 1. Referring to FIG. 1, the rocking member 9*b* is pivotally disposed on a fixed pivot 14*b* for oscillation about the pivot 14*b* upon being pulled by the dobby 3 through the harness cord 6*b*. This oscillation is converted through the connecting rod 7b to the heddle frame 5 which in turn opens and closes the shed. The rocking member 9b has its neutral reference position determined by the length of the harness cord 6b and the spring rate of the spring 11a. One feature of this rocking member 9b according to this invention is that it permits change of reference position in the following manner. The rocking member is formed therein with an arcuate guide groove 15b along which the harness cord 6b is passed. A through-hole 20b is bored in the rocking member 9b. The through-hole 20b opens at one end 17b externally of the side of the rocking member 9b and at the opposite end communicate with the guide groove 15b. A central part of the wall of the through-hole 20b is removed to provide an access cutout 16b which provides access to the inside of the through-hole 20b. An externally threaded rod 19b is movably disposed in the through-hole 20b for free movement therethrough. One end of the rod 19b is made integral with the opposite end of the harness cord 6b by means of a clamp means 18b. An adjustment nut 21b is internally threaded to receive engageably the rod 19b and is abutted against the edge of the open end 17b of the through-hole 20b, fixed in place, since the adjustment nut 21b is made to have its outside diameter larger than the diameter of the through-hole 20b. With this arrangement, when the adjustment nut 21b is turned in either direction, the rod 19b engaged therewith advances or retracts relative to the adjustment nut 21b, whereby rocking member 9b oscillates into a new reference position through the angle that is determined by the amount of turns in the adjustment nut 21b. This results in the dobby 3 supporting the heddle frame 5 at a changed position or level.

The pivot 8b to which the connecting rod 7b is pivoted is spaced from the pivot 14b, at which the rocking member 9b is rotatably disposed, such that the distance "R" between both pivots is greater than the radius "r" for the guide groove 15b. The distance of movement that is imparted to the harness cord 6b by the jack lever 4 of the dobby in its stroke is multiplied by R/r to provide the distance traveled by the heddle frame that is controlled by that jack lever 4. In other words, the full operating distance by which the heddle is reciprocated by the stroke of the jack lever is increased simply by increasing R/r. This feature serves to allow use of a smaller dobby.

The spring 11b is connected at the upper end to the rocking member 9b through a link member 22b that is pivoted to a fixed pin 23b between the pivots 8b and 14b. The lower end of the spring 11b is fixed to the spring plate 13b secured to the mounting bracket 12b between the side plates thereof. The mounting bracket 12 itself is secured to the side column 16 by means of bolts 24b.

The rocking member 9b, the connecting rod 7b, the spring 11b, and the adjusting nut 21b are all situated internally of the side column 1b above the heddle frame 5. This is also true of their counterpart mounted on the righthand side in FIG. 1 including the rocking member 9a. Referring then to FIG. 1, when both harness cords 6a and 6b are pulled for a given equal distance at the same time in the direction indicated by the arrow 25, the rocking member 9a is rotated counterclockwise about the pivot 14a while the other rocking member 9b oscillates in the clockwise direction about its pivot 14b, both against the forces of the associated springs 11a and 11b. Thereupon, the heddle frame 5 is raised through the connecting rods 7a and 7b, whereby the shed is opened with respect to the other heddle frames that are operated in the opposite direction. The tensions on the harness cords 6a and 6b are lost when the jack lever 4 is released in the dobby 3, whereby the rocking members 9a and 9b rotate back to their original positions.

The plural heddle frames 5 on a loom are set or adjusted to the same specified level initially when the loom is installed and periodically since deviations from the correct position occur from use. This adjustment, called leveling, may happen to be performed by a single person. With a loom equipped with the improved means for adjusting the level of heddle frames according to the present invention, leveling can be performed in an easy and assured manner by a single person, who, while keeping an eye on the heddle frame that is in full view from where he is adjusting, adjust the adjustment nut. To illustrate, assume that leveling is performed on a loom carrying 8 heddles. First, the outermost two heddle frames 5 are adjusted to the specified level by turning the associated adjustment nuts. Then, a layout level, indicated at 27 in FIG. 3, is placed on the upper cross members 5a of these adjusted heddle frames 5. Subsequently, the adjustment nuts for the rest of the heddle frames are turned in or out until the upper cross member 5 of each frame reaches the bottom side of the layout level.

Figure 4:
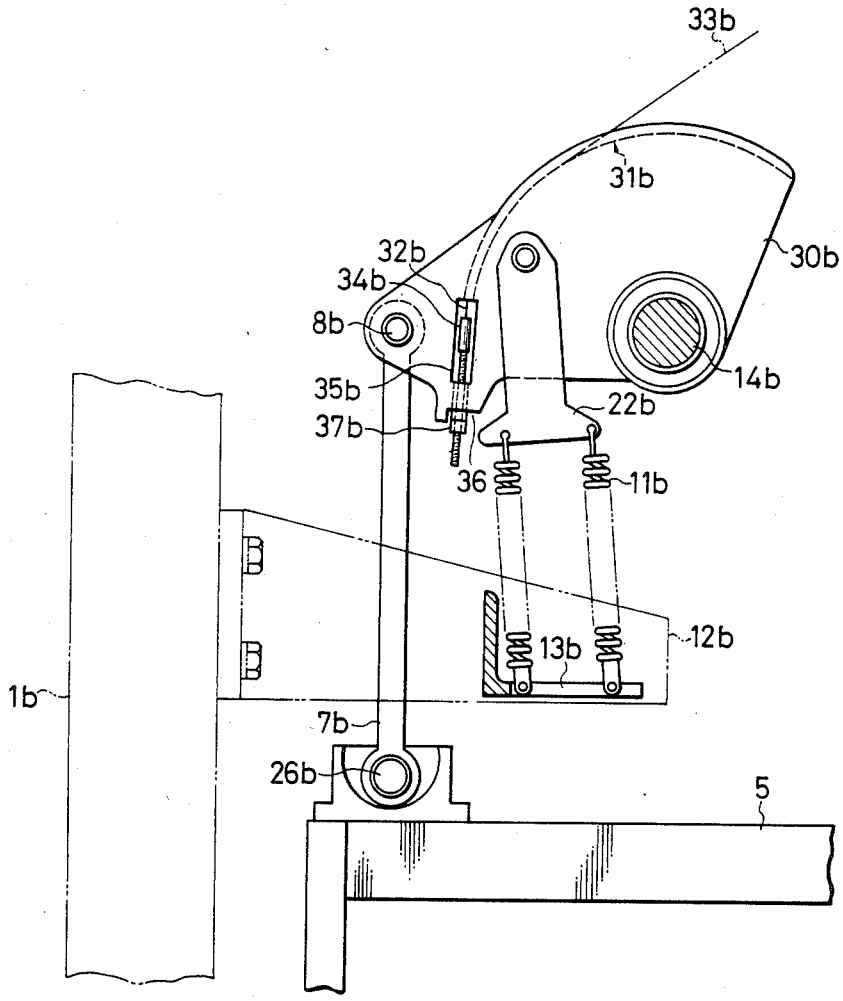
FIG. 4 is an enlarged front view of a second preferred embodiment of this invention.

FIG. 4 is a modified form of the means for adjusting the level of heddle frames of FIG. 2. Referring to the drawing, a rocking member 30b is formed therein with a guide groove 31b. A through-hole is formed to open at. its one end at the side face 36 of the rocking member 30b and communicate at the opposite end with the guide groove 31b. A part of the wall of the through-hole is removed to provide an access cutout 32b which provide access to the inside of the through-hole. An externally threaded rod 35b is movably disposed within the through-hole for movement therein upon being pulled by the jack lever 4 through the harness cord 33b that is passed through the guide groove 31b. The rod 35b is secured to the harness cord 33b by means of a clamp means 34b. An adjusting nut 37b is internally threaded to receive the rod 35b and is abutted against the edge of the through-hole, secured in the fixed position to the rocking member 30b. The reference position of the rocking member 30b is adjusted by turning the adjustment nut 37b in the same manner as in the rocking member 9b. In this particular embodiment, however, the guide groove 31b and the through-hole adjacent thereto are formed to provide a passage that is substantially an arc so that the back and forth movement of the harness cord 33b therethrough to operate the heddle frame for shedding is performed smoothly, the harness cord being subjected to uniform stress throughout its length. The relative position of the pivot 8b to the pivot 14b and the manner in which the spring 11b is mounted in the rocking member 30b are similar to the rocking member 9b, and will not be described to avoid repetition. It is to be noted that the rocking member 30b is for mounting on the lefthand side of the loom in FIG. 1 and that there is a counterpart mounted on the righthand side which is similar in design to the rocking member 30b except that the harness cord is passed around a cable pulley.

Figure 5:
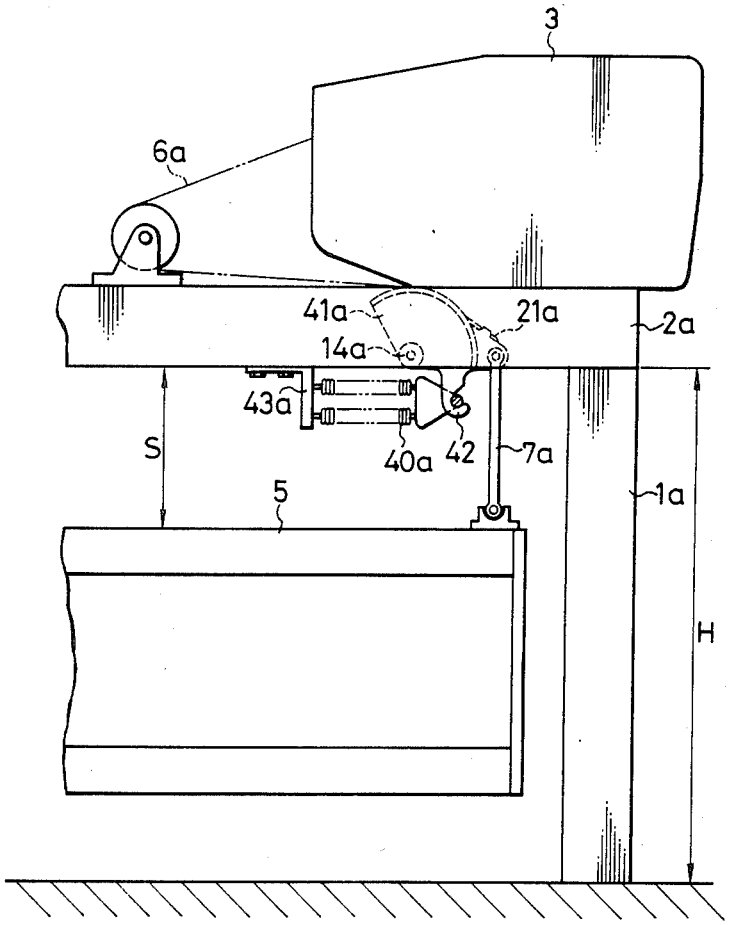
FIG. 5 is a partial front view of a third preferred embodiment of this invention.

FIG. 5 is also a modified form of the means of FIG. 2 Referring to FIG. 5, a means for adjusting the level of heddle frames including a rocking member 41a, which is for mounting on the righthand side of the loom in FIG. 1, is provided and is substantially similar to the means of FIG. 2 except in the manner a spring 40a, the counterpart to the spring 11b of FIG. 2, is mounted.

The rocking member 41*a* is provided at its lower end with an engaging hook 42. One end of the spring 40*a* is engaged in the engaging hook 42, the other end of the spring 40*a* is secured to a mounting bracket 43*a* that is fixed to the underside of the crossbeam 2*a*. In a loom, the spring 40*a* which urges the heddle frame 5 in the downward direction must has a great spring rate to properly operate the frame on the return stroke, which requires a longer dimension of spring. According to the means of FIG. 5, the spring 40*a* can have a long dimension since it is supported in the horizontal position. This also permits the overall height of the loom to be decreased. In addition, the spacing between the heddle frame and the crossbeam 2*a* of the frame can be reduced. Consequently, the position of the adjustment nut 21*a* comes low so that leveling can be performed more easily. In one example, the overall height (H) of a loom may be abcut 1.7 meters. The region of the spring 40*a*, mounting bracket 43*a* and engaging hook 42 may be shielded with a cover plate in order to improve on the external appearance of the loom.

In the above embodiments, the means for adjusting the level of heddle frames and the springs are mounted internally of the side columns l*a* and l*a* in such a manner that adjustments at the means are performed between the associated spring and the nearer side column. This layout is particularly advantageous with a shuttleless loom and more so with such a loom of the air jet type in which the weft thread is shot in by the action of an air jet. Since water is not used as is so with the water jet looms, the springs are unlikely to corrode and, thus, will have a longer service life without breakage due to the corrosion. This is well attested by an actual example which indicates that two years of operation gave two or three broken springs out of 1500 used in a large number of looms of the air jet type. The cycle at which the level of the heddle frames is adjusted at the adjusting screws may be monthly. Consequently, the springs which are replaced less frequently may be installed far inside from the side columns, without causing any inconvenience at all in the operation of the loom.

The fourth embodiment, in which the length of the connecting rod of the heddle frame may be adjustable, will be described hereinafter.

Figure 6:
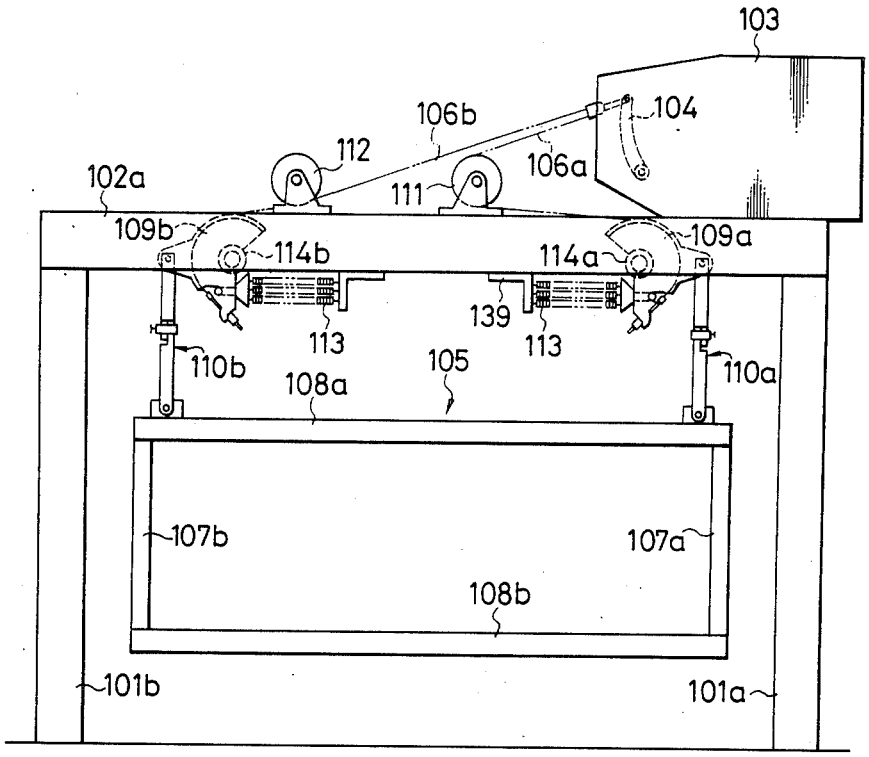
Figure 14:
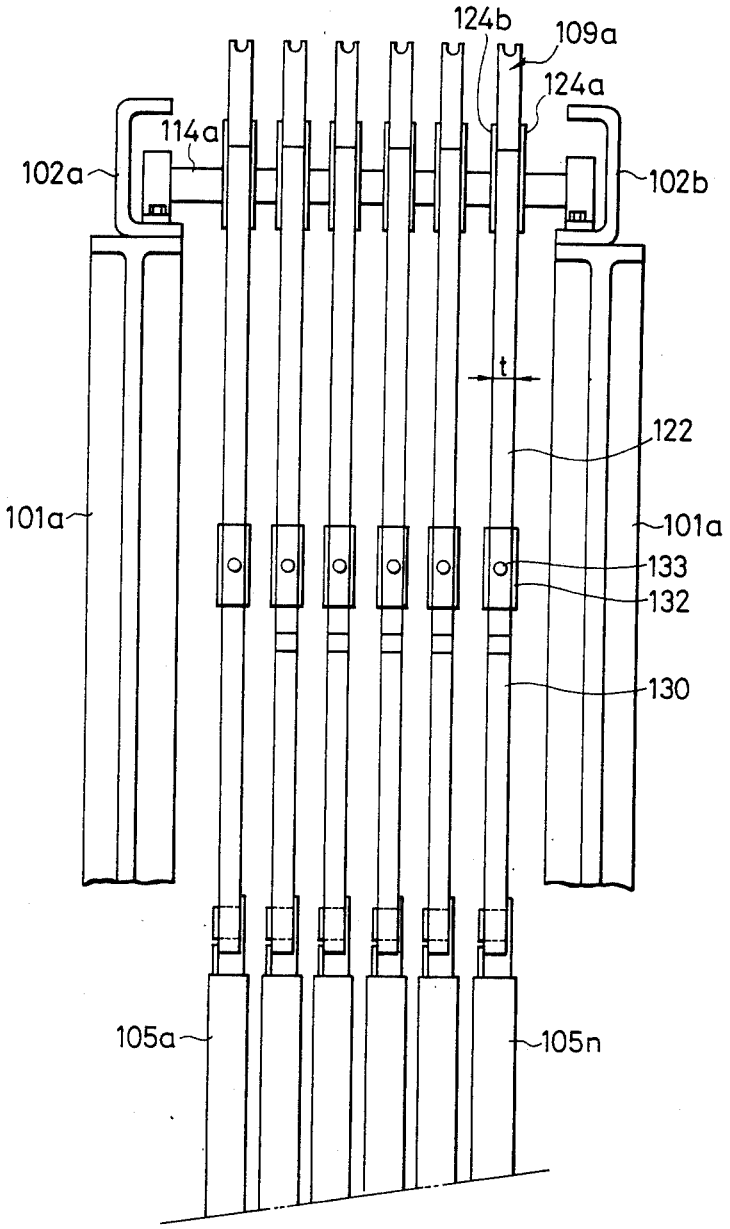

Referring to FIG. 6, a dobby 103 is mounted on a crossbeam 102*a* extending between side columns 101*a* and 101*b*. Harness cords 106*a* and 106*b* for operating a heddle frame 105 are connected to one of the jack levers 104 of the dobby 103. The heddle frame 105 has a heddle frame consisting of side frame members 107*a* and 107*b* and a lower and an upper cross member 108*a* and 108*b*, and a plurality of healds, not shown, supported on the heddle frame. Each heddle has an eye through which an individual warp thread is passed. A plurality of the heddle frames 105*a* to 105*n* are arranged one after the other on the loom as shown in FIG. 14. A pair of rocking members 109*a* and 109*b* are interposed in the motion transmitting passages between the dobby unit 103 and the heddle frame 105. The rocking members 109*a* and 109*b* and the heddle frame 105 are connected by means of connecting rods 110*a* and 110*b*. The harness cords 106*a* and 106*b* are extended from the dobby 103 through intermediate rollers 111 and 112 to the rocking members 109*a* and 109*b* respectively to interconnect the dobby 103 and the rocking members 109*a* and 109*b*. Each of the harness cords is provided at one end thereof with a length adjusting means. The rocking members 109*a* and 109*b* are urged rotatively with springs 113*a* and 113*b* respectively in a direction to move the heddle frame 105 downward.

Accordingly, the heddle frame 105 is lifted up positively as the corresponding jack lever is actuated to form a shed, while the heddle frame 105 is lowered negatively by the agency of the springs 113*a* and 113*b*, the dead weight of its own and the tension of the warps. However, it is also possible to lower the heddle frame positively by the agency of the dobby and to lift up the heddle frame negatively to the original position by means of the springs, by changing the respective positions of supporting shafts 114*a* and 114*b* supporting the rocking levers respectively and the respective joints between the connecting rods 110*a* and 110*b* and the corresponding rocking members. The present invention is applicable to either one of the above-mentioned cases.

Figure 7:
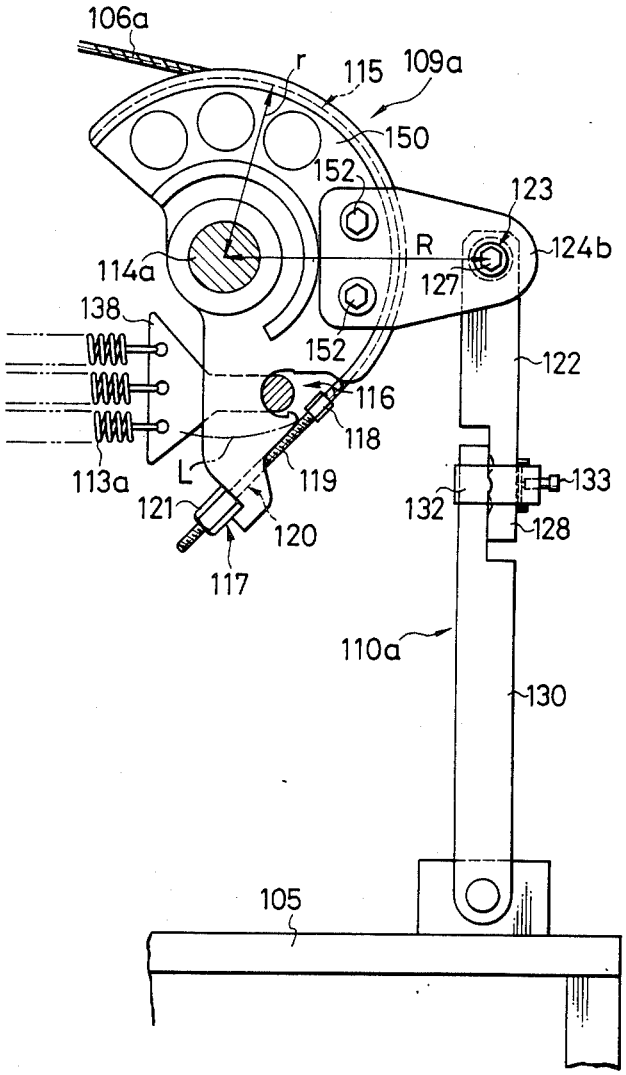

FIG. 7 shows the details of the joint between one of the rocking member 109*a* and the heddle frame 105. Naturally, the configuration of the joint is the same with the other rocking member 109*b*. Referring FIG. 7, a guide groove 115 of a circular arc having a radius r is formed in the rocking member 109*a* supported pivotally on a pivot 114*a*. A recess 116 for anchoring the springs is formed after the guide groove 115 in the rocking member 109*a*. A harness cord length adjusting device 117 is provided at the lower extremity of the rocking member 109*a*. Since the extremity of the harness cord 106*a* is fixed to the rocking member 109*a* at a position outside the imaginary arc L, that is, the circular arc having a radius r, the harness cord is bent always along a curve having a radius greater than the radius r, which extends the life of the harness cord and lowers the position of the adjusting device for easy harness cord length adjustment. A clamp member 118 is fixed to the free end of the harness cord 106*a* connected at the other end thereof to the jack lever. A threaded rod 119 is fixed to the clamp member 118. The threaded rod 119 is inserted through a through hole 120 formed in the rocking member 109*a* and a nut 121 is screwed on the threaded rod 119. The layout level of the rocking member 109*a* is adjusted by turning the nut 121 to align the respective layout levels of all the rocking members for all the heddle frames.

One rod member 122 of the connecting rod 110*a* is joined pivotally, at the upper end thereof, to a projection projecting from the rocking lever 109*a* with a pivot 123. The center distance R between the pivot 114*a* and the pivot 123 is greater than the radius r, namely, $R>r$, and hence the output displacement of the dobby unit is transmitted to the heddle frame after being multiplied by R/r.

Figure 8:
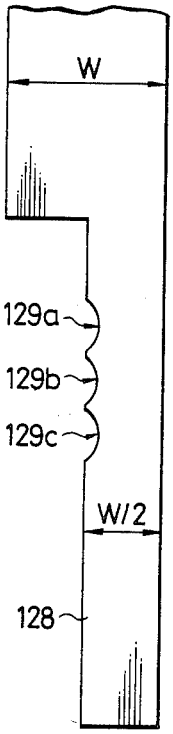
Figure 9:
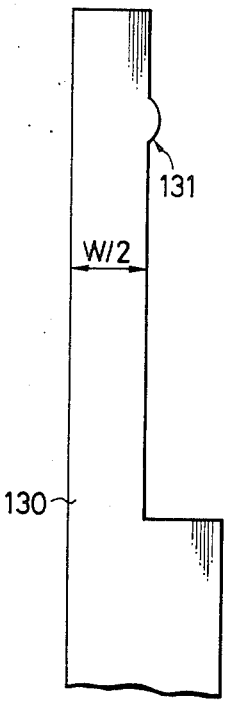

An adjusting part 128 having a width approximately half the width W of the rod member 122 is formed in the lower end of the rod member 122. A plurality of semicylindrical recesses 129*a* to 129*c* are formed in one surface of the adjusting part 128 as shown in FIG. 8. On the other hand, the upper end of the other rod member 130 of the connecting rod 110*a* is cut in a width (W/2) approximately the same as the width of the adjusting part 128 of the rod member 122 as shown in FIG. 9. A semicylindrical protrusion 131 which fits in the recess 129*a*, 129*b* or 129*c* is formed in the upper end having the width W/2 of the rod member 130. The adjusting part 128 and the upper end of the rod member 130 have the same thickness t. The adjusting part 128 and the rod member 130 are inserted into a clamp 132 with the protrusion 131 fitted in one of the specific recesses, the recess 129*b*, for instance, and then the bolt 133 of the clamp 132 is fastened to join the rod members 122 and 130 in a single rod.

Figure 10:
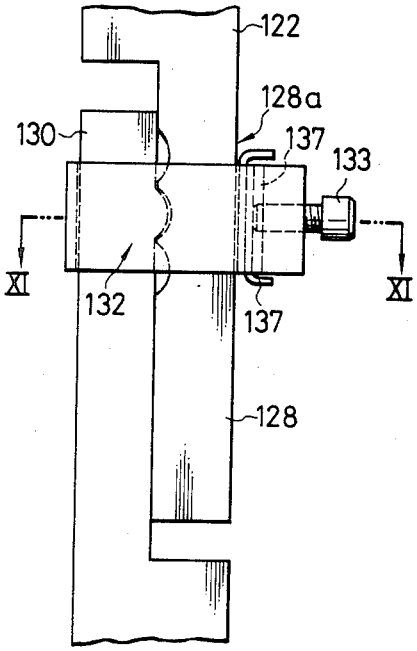
Figure 11:
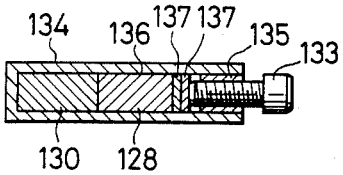

An example of the clamp 132 is shown in FIGS. 10 and 11. In the clamp 132, a through hole 136 for receiving the adjusting part 128 and the upper end of the rod member 130 is formed by screwing or welding a block 135 to a U-shaped member 134. In joining the rod members 122 and 130, the adjusting part 128 and the upper end of the rod member 130 are inserted into the through hole 136, washers 137 are placed on one surface 128*a* of the adjusting part 128, and then a bolt 133 screwed through the block 135 is fastened so as to apply a pressure to the washers 137 so that the rod members 122 and 130 are clamped firmly.

The combination of the protrusion 131 of the rod member 122 and the recess 129*a*, 129*b* or 129*c* of the rod member 130 is decided selectively to decide the total length of the connecting rod 110*a* and thereby the height of the heddle frame 105 can be decided selectively with the rocking member 109*a* held at a fixed position. Serrations may be formed over the engaging surfaces of the adjusting part 128 and the upper end of the rod member 130, instead of the semicylindrical protrusion and the semicylindrical recesses, or the engaging surfaces may be formed simply in planes for the continuously variable adjustment of the overall length of the connecting rod 110*a*.

Figure 12:
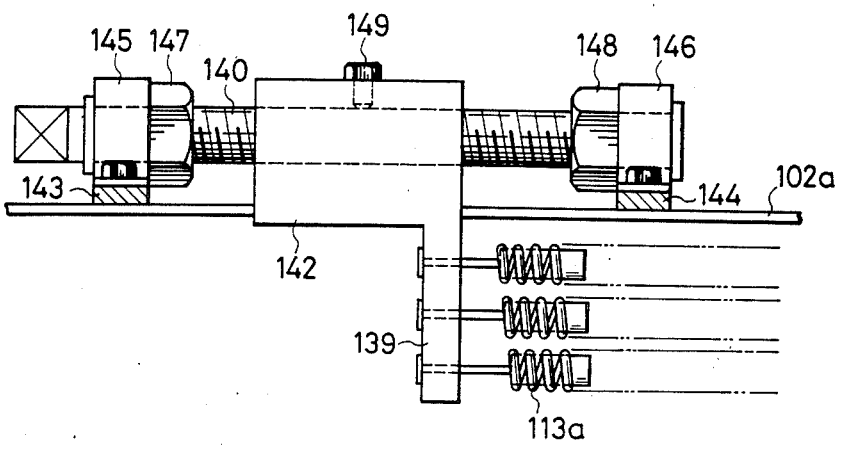
Figure 13:
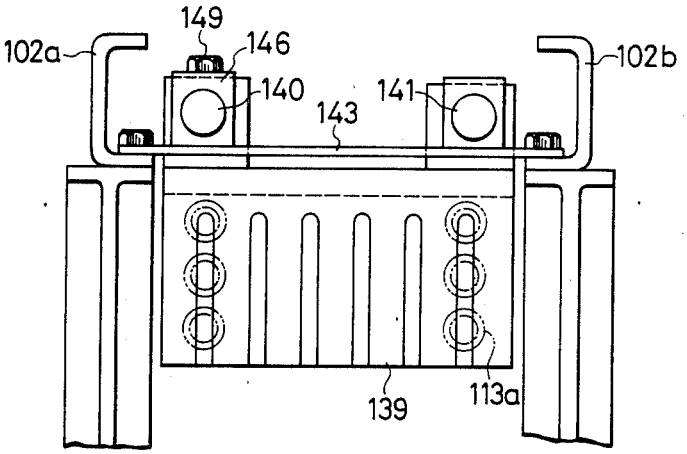

Furthermore, in FIG. 7, a spring holding plate 138 is anchored in the recess 116 of the rocking member 109*a*. The springs 113*a* are extended between the spring holding plate 138 and a supporting plate 139 held on the crossbeams 102*a* and 102*b* as shown in FIG. 12. A guide block 142 is formed integrally with the supporting plate 139. A threaded rod 140 and a guide rod 141 penetrate through the guide block 142 to support the same. The threaded rod 140 is turned with a wrench to move the supporting plate 139 laterally as viewed in FIG. 12 to adjust the tension of the springs. Thus the pulling force that works on the rocking member 109*a* can be adjusted without changing the number of the springs. The threaded rod 140 and the guide rod 141 are supported on bearings 145 and 146 provided on brackets 143 and 144 fixed to the crossbeams 102*a* and 102*b*. After adjusting the tension of the springs, locking nuts 147 and 148 and a bolt 149 for locking the block 142 are fastened to fix the block firmly at the position. The above-mentioned mechanism for adjusting the tension of the springs is merely an example and other mechanism, such as a ratchet type mechanism or a turnbuckle type mechanism may be employed.

The extension of the springs 113*a* for returning the heddle assembly in parallel to the crossbeam 102*a* practically horizontally enables the effective use of the space between the rocking lever 109*a* and the heddle frame 105 for adjusting the length of the connecting rod, which has almost been impossible in the conventional vertical arrangement of the springs. The rocking lever 109*a* can be placed at a lower position as compared with the position of the same in the conventional loom, and thereby the adjustment of the harness cord is facilitated to advantage.

Furthermore, since the connecting rods 110*a* and 110*b* are disposed outside with respect to the springs 113*a* and 113*b* respectively, namely, nearer to the side columns 101*a* and 101*b* respectively, the length of the connecting rods can easily be carried out from the side of the loom.

As apparent from what has been described hereinbefore, in the above-mentioned embodiment of the present invention, the connecting rod interconnecting the rocking member and the heddle frame is divided into two overlapping rod members so that the overall length of the connecting rod can be adjusted by adjusting the overlap, therefore, the vertical position of the heddle frame can be changed without changing the layout level of the rocking lever, and hence the position of the shed can be changed without changing the shedding stroke of the heddle frame.

What is claimed is:

1. Means for lifting motion of a heddle frame for use in a dobby having a heddle frame and a harness cord adapted for operating said heddle frame, wherein said means is installed internally of side columns of a frame of a loom wherein said means includes:

an externally threaded rod secured to one end of said harness cord;

a rocking member pivotally disposed and connected to said heddle frame by means of a connecting rod;

a spring interconnected between said rocking member and a fixed position for urging said rocking means to a reference position;

a corossbeam;

a guide rod and a threaded rod provided adjacent to the crossbeam; and an adjustment nut engaged with said rocking member and internally threaded to receive said threaded rod;

said rocking member being pivoted to move said heddle frame in one direction against the action of said spring upon being pulled by said dobby through said harness cord;

said rocking member being allowed to oscillate back to said reference position moving said heddle frame in the opposition direction, being pulled by said spring, upon the pull on said harness cord being released;

said adjustment nut being turned in either direction to cause said threaded rod to move relative thereto to therbyt set said rocking member to a new reference position;

wherein one end of said spring is engaged in an engaging hook which is provided in the lower end of the rocking member and the other end of said spring is secured to an engaging member disposed at underside of said horizontal crossbeam so that the spring is expanded in a horizontal direction;

wherein said engaging member is provided to be movable along the horizontal crossbeam;

wherein said engaging member comprises a guide block integrally formed with a supporting plate, and having apertures therethrough through which said guide rod and said threaded rod may pass, said threaded rod being turned to move the supporting plate along the guide rod adjacent to the horizontal crossbeam to adjust the tension of the spring

2. Means as claimed in claim 1, wherein said connecting rod comprises a first connecting rod piece which has an adjusting part having a width substantially half of the width of the connecting rod piece in the lower end portion thereof, said adjusting part being formed of a plurality of engaging means in one surface thereof, a second connecting rod piece which has an adjusting part having a width substantially half of the width of the connecting rod piece in the upper end portion thereof, said adjusting part having a plurality of protrusions which may fit in any of the engaging means in one surface thereof, and a clamp member for fastening to join the first and second connecting rod pieces in a single rod.

3. Means as claimed in claim 2, wherein said clamp member is a U-shaped member having a through hole for receiving the adjusting parts of the first and second conecting rod pieces and an opening, at said opening a fastening means including a bolt being provided to clamp the connecting rod pieces firmly.

* * * * *